US005924690A

United States Patent [19]

Kopera et al.

[11] Patent Number: 5,924,690

[45] Date of Patent: Jul. 20, 1999

[54] DROP TARGET FOR A PINBALL GAME

[75] Inventors: Thomas M. Kopera, Villa Park; Matthew C. Coriale, Algonquin, both of Ill.

[73] Assignee: Williams Electronic Games Inc., Chicago, Ill.

[21] Appl. No.: 09/039,638

[22] Filed: Mar. 16, 1998

[51] Int. Cl.[6] ..... A63F 7/30

[52] U.S. Cl. ..... 273/127 R; 273/118 A; 273/119 A; 273/121 A

[58] Field of Search ..... 273/118, 119, 273/121, 127 R, 13

[56] References Cited

U.S. PATENT DOCUMENTS

| | | | |
|---|---|---|---|
| 3,578,802 | 5/1971 | Murphy et al. . | |
| 3,826,883 | 7/1974 | Foster et al. . | |
| 3,877,701 | 4/1975 | Foster et al. . | |
| 4,037,842 | 7/1977 | Breslow . | |
| 4,097,047 | 6/1978 | Ochi . | |
| 4,109,916 | 8/1978 | Breslow et al. . | |
| 4,190,252 | 2/1980 | Kindig | 273/127 R |
| 4,221,384 | 9/1980 | Krynski | 273/127 R X |
| 4,243,222 | 1/1981 | Grabel et al. . | |
| 4,249,736 | 2/1981 | Rosenthal | 273/127 R |
| 4,257,604 | 3/1981 | Grabel et al. | 273/127 R |
| 4,260,156 | 4/1981 | Momura | 273/127 R |
| 4,353,553 | 10/1982 | Krynski | 273/127 R X |
| 4,354,681 | 10/1982 | Garbark | 273/127 R X |
| 4,426,081 | 1/1984 | Fainzilberg . | |
| 4,429,876 | 2/1984 | Halliburton et al. . | |
| 4,438,929 | 3/1984 | Peters | 273/127 R |
| 4,460,175 | 7/1984 | Krynski . | |
| 4,487,416 | 12/1984 | Peters . | |
| 4,508,343 | 4/1985 | Peters et al. . | |
| 4,773,646 | 9/1988 | Joos, Jr. et al. . | |
| 4,804,186 | 2/1989 | Moravec | 273/127 R |
| 4,822,046 | 4/1989 | Kim et al. . | |
| 4,892,309 | 1/1990 | Kim et al. . | |
| 4,943,061 | 7/1990 | Grabel | 273/127 R |
| 4,981,298 | 1/1991 | Lawlor et al. . | |
| 5,123,647 | 6/1992 | Lawlor et al. . | |
| 5,516,103 | 5/1996 | Lawlor et al. | 273/127 R |
| 5,529,294 | 6/1996 | Nordman et al. . | |

OTHER PUBLICATIONS

Pinball Drop Target (Williams) Photograph 1: Side view, target raised (Jul. 1998).

Pinball Drop Target (Williams) Photograph 2: Front view, target raised (Jul. 1998).

Pinball Drop Target (Williams) Photograph 3: Back view, target raised (Jul. 1998).

Pinball Drop Target (Williams) Photograph 4: Side view, target lowered (Jul. 1998).

Pinball Drop Target (Williams) Photograph 5: Front view, target lowered (Jul. 1998).

Pinball Drop Target (Williams) Photograph 6: Back view, target lowered (Jul. 1998).

Description of Prior Art Photographs 1–6, 2 pgs., date Jul. 1998.

*Primary Examiner*—Raleigh W. Chiu
*Attorney, Agent, or Firm*—Arnold White & Durkee

[57] ABSTRACT

A drop target for a pinball game includes a movable target element operably connected to a target driver. The target driver is controllably movable in response to energizing pulses from a game controller. A releasable latching mechanism moves in cooperation with the target driver and, when attached to the target element, communicates movement from the target driver to the target element so as to move the latter between a raised and lowered position. The target driver in one embodiment comprises a single solenoid including a coil and a plunger concentric with the coil. The plunger and target element move to a raised position in response to the game controller applying an initial energizing pulse to the coil. Thereafter, the game controller maintains the target in its raised position by applying a variable pattern of energizing pulses to the coil. The target is moved back to its lowered position when struck by a pinball or, in a controlled drop, when the game controller terminates the pattern of energizing pulses.

27 Claims, 3 Drawing Sheets

DROP TARGET FOR A PINBALL GAME

FIELD OF THE INVENTION

The present invention relates generally to pinball games and, more particularly, to a drop target play feature for a pinball game.

BACKGROUND OF THE INVENTION

Pinball games are well known amusement devices which include, generally, an inclined playfield housed within a game cabinet, with a plurality of play features arranged on the playfield. A player uses flippers to maintain a game ball (i.e., pinball) on the playfield and to direct the pinball toward the various play features on the playfield. Points are awarded upon the pinball striking the various play features. Generally, the appeal of a pinball game to players, and thereby the marketability of the game, depends on the particular arrangement of play features on the playfield and the challenge and excitment offered by the play features. Accordingly, to maintain player interest, there is a continuing need for manufacturers to develop pinball games with new game features and/or new arrangements of game features.

Drop targets are a popular pinball game feature, consisting generally of a target element movable between a raised and lowered position. In its raised position, the target element projects above the playfield such that it may be targeted by a skilled player whereas, in its lowered position, the target element is retracted below the playfield. The target element is normally biased in its lowered position under spring tension. To move the target element to its raised position, a reset mechanism incorporating a solenoid is energized by a game controller to lift the target element into engagement with a catch mechanism. Thereafter, the target can be "dropped," or retracted to its lower position by striking the target with a pinball and causing it to become disengaged from the catch mechanism. Alternatively, a "controlled drop" may be executed in which the target is retracted to its lower position in response to instructions from a game controller. Heretofore, controlled drop target mechanisms have been implemented with a striking mechanism incorporating a second solenoid. When the second solenoid is energized by the game controller, the striking mechanism is driven forward to strike the target and disengage it from the catch mechanism in generally the same manner as would occur with a pinball.

Controlled drop targets provide a pinball game designer the flexibility to create different playfield arrangements in a single machine, by controllably raising and lowering the targets at various times during play of the game. Generally, players enjoy the multiple playfield arrangements and additional challenges made possible by controlled drop targets. Therefore, it is generally desirable for the designer to utilize an optimal number of controlled drop targets in a pinball game. Nevertheless, with the presently known form of drop target incorporating a striking mechanism with a second solenoid, only limited numbers of controlled drop targets may be employed in a particular machine without exceeding reasonable space, power and cost limitations associated with the machines. Moreover, these additional striking solenoids add to stress, vibration, etc., which can shorten machine life or drop target life, increase the frequency of repairs, the complexity of the unit, and adversely affect space, cost and power consumption.

Accordingly, there is a need for a controlled drop target for a pinball game which incorporates fewer moving parts, occupies less space, consumes less power and/or is more economical to manufacture than presently known controlled drop targets, such that it may be incorporated in pinball games in greater numbers relative to presently known controlled drop targets without exceeding space, power and cost constraints. The present invention is directed to satisfying these needs.

SUMMARY OF THE INVENTION

In accordance with one aspect of the present invention, there is provided a drop target for a pinball game including a target element, a target driver and a latching mechanism for linking the target driver to the target element. The target element is movable between a raised and lowered position. The target driver is movable between a first and second position. When the target driver is moved from the first position to the second position, the latching mechanism moves the target element first to one of the raised and lowered positions. When the target driver is moved from the second position to the first position, the latching mechanism moves the target element to the other one of the raised and lowered positions.

In one embodiment, the target driver comprises a solenoid including a coil and a plunger concentric with the coil. The coil is energizable to create a magnetic field about the plunger and de-energizable to extinguish the magnetic field about the plunger. The plunger is biased in the absence of a magnetic field in the first target driver position and moves upon the creation of the magnetic field from the first target driver position to the second target driver position. The plunger moves upon termination of the magnetic field from the second target driver position to the first target driver position.

In accordance with another aspect of the present invention, there is provided a drop target for a pinball game comprising a target element having a latching surface, a movable latching mechanism engagable with the latching surface, and means for moving the latching mechanism between a first and second position. When the latching mechanism is engaged with the latching surface, the target element moves in cooperation with the latching mechanism. When the latching mechanism is in the first position, the target element is in a lowered position. When the latching mechanism is moved to the second position, the target element is moved to a raised position. In one embodiment, the means for moving the latching mechanism is a target driver comprising a solenoid including a coil and a plunger concentric with the coil. The coil is energizable in response to control signals to create a magnetic field about the plunger. The plunger is biased in the absence of a magnetic field in a first target driver position. Upon application of an initial energizing pulse to the solenoid, the plunger moves from the first target driver position to a second target driver position. Thereafter, a pattern of succeeding energizing pulses is applied to the solenoid to maintain the plunger in the second target driver position.

In accordance with another aspect of the invention, there is provided means for terminating the pattern of energizing pulses applied to the solenoid, the plunger moving from said second target driver position to said first target driver position, the latching mechanism moving from said second vertical position to said first vertical position and the target element moving from said raised target position to said lowered target position in response to termination of the pattern of energizing pulses.

BRIEF DESCRIPTION OF THE DRAWINGS

The foregoing and other advantages of the invention will become apparent upon reading the following detailed description and upon reference to the drawings in which.

Figure 1:
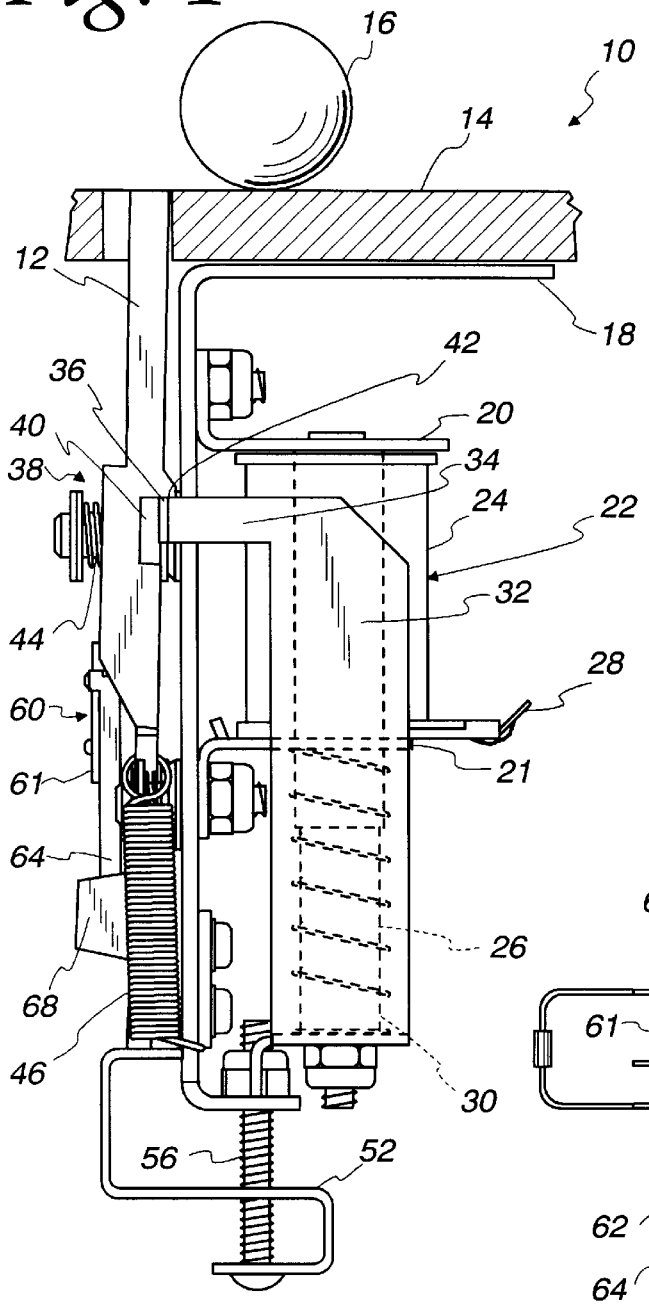
FIG. 1 is a side view of a drop target for a pinball game in a lowered position according to one embodiment of the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

Description of Specific Embodiments

Figure 2:
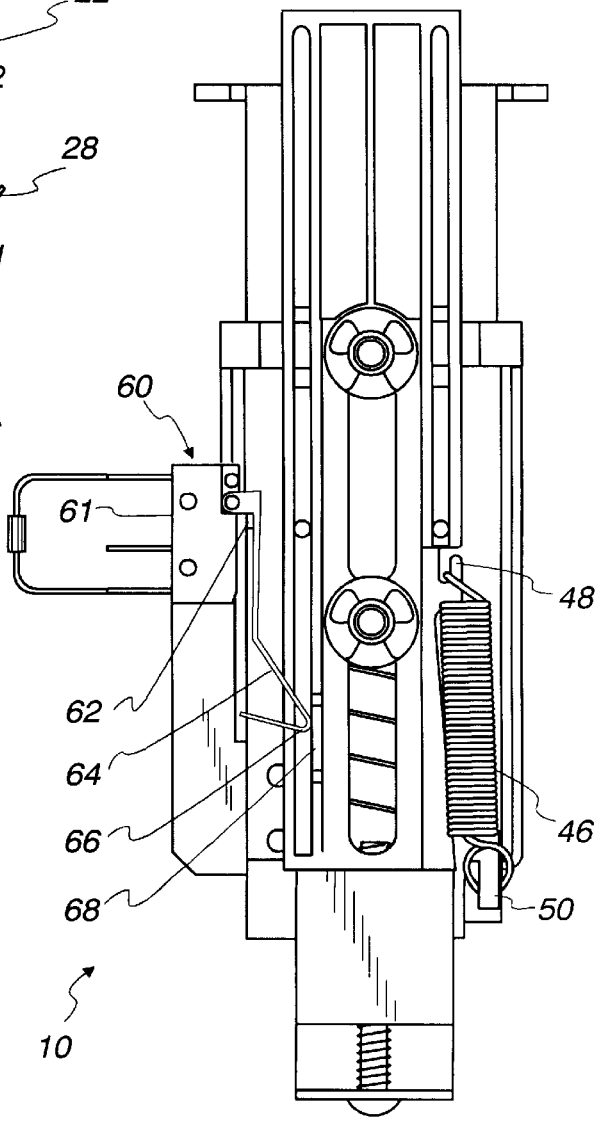
FIG. 2 is a rear view of the drop target of FIG. 1 in the lowered position.
Figure 3:
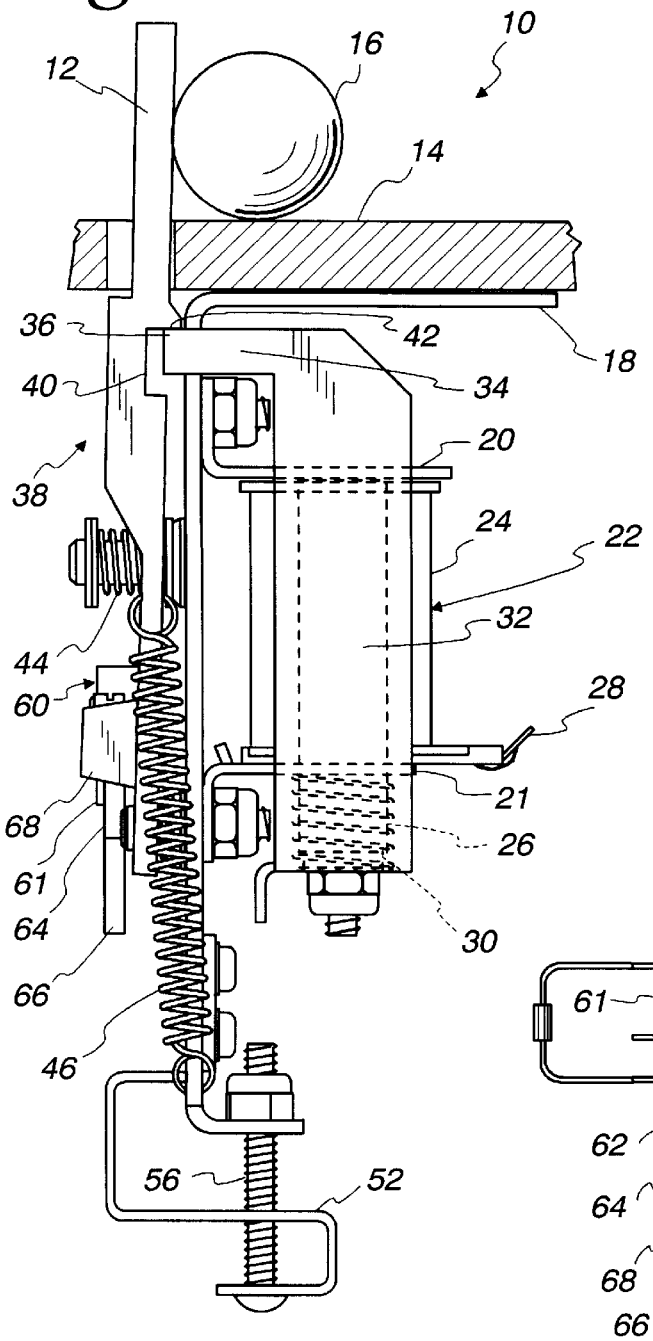
FIG. 3 is a side view depicting the drop target of FIG. 1 in a raised position.
Figure 4:
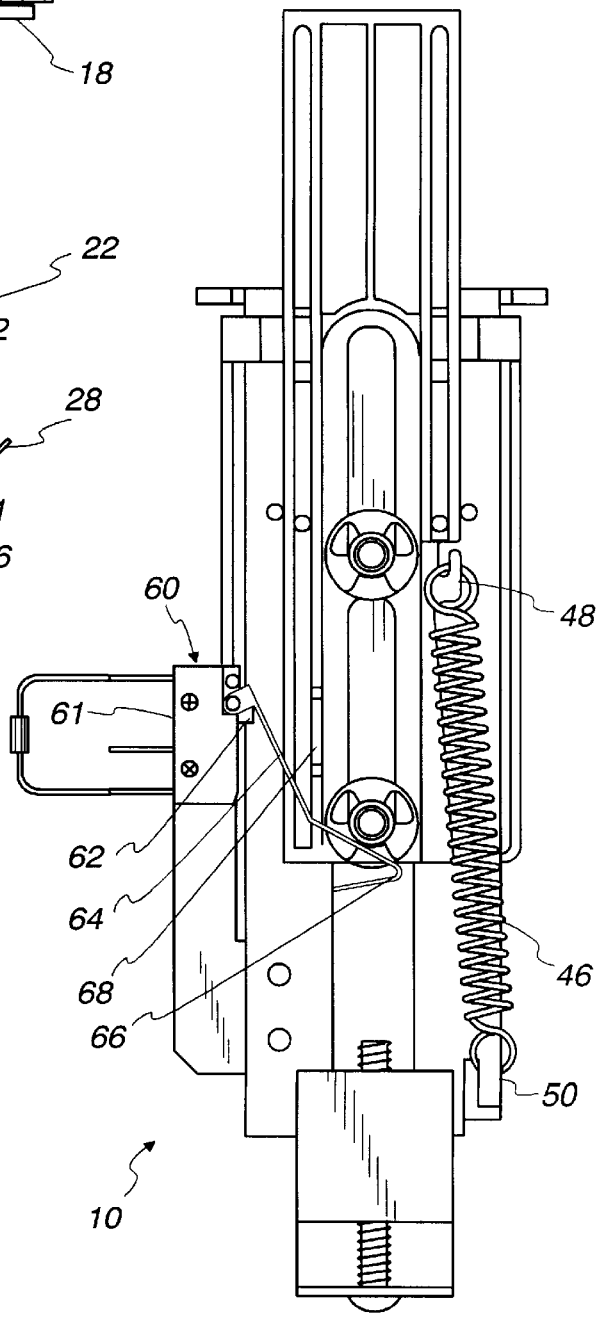
FIG. 4 is a rear view of the drop target of FIG. 1 in the raised position.

Turning now to the drawings, there is shown a drop target for a pinball game, designated generally by reference numeral 10. The drop target 10 includes a target element 12 movable between a lowered position (FIGS. 1 and 2) and a raised position (FIGS. 3 and 4). In its lowered position, as best observed in FIG. 1, the target element 12 is retracted below the playfield 14 of the pinball game. In its raised position, as best observed in FIG. 3, the target element 12 projects above a playfield 14 such that a skilled player may direct a pinball 16 toward the target element 12.

A mounting bracket 18 secures the drop target 10 to the underside of the playfield 14 and maintains the drop target 10 in an orientation generally perpendicular to the playfield 14. Usually the playfield is at a slight angle to horizontal, such that the target deviates slightly from vertical. However, other orientations of the target and playfield are possible, with the target intersecting the playfield at an angle appropriate to the game or function of the target when in a raised position. Secondary brackets 20, 21 are provided for attaching a solenoid 22 to the mounting bracket 18. The solenoid 22 includes a coil 24, plunger 26 and electrical contacts 28—28 (one of which is obscured by the other in FIGS. 1 and 3) through which an energizing signal may be applied. The plunger 26 is initially biased toward a lowermost vertical position (FIG. 1), in which its distal end 30 projects a distance of about four centimeters below the coil 24. Upon application of an energizing signal, a magnetic field is generated which drives the plunger 26 into the coil until it reaches an uppermost vertical position (FIG. 3) in which the distal end 30 of the plunger 26 projects only about one centimeter below the coil. In one embodiment, the coil 24 consists of 1500 turns of 26 gauge copper wire. It will be appreciated however, that alternative sizes and/or types of coils may be used. Coils having fewer or greater numbers of turns and/or using different gauge wire may be used, for example, to meet space and power constraints. Similarly, alternative sizes and/or types of plungers may be used, for example,to alter the upper and lower positions and/or to alter the range of motion of the plunger 26 as needed or desired. Target drivers other than solenoids may also be used.

In the illustrated embodiment, the plunger 26 is connected at its distal end 30 to an actuator bracket 32. The actuator bracket 32 includes identical, opposed left and right arms 34—34 (one of which is obscured by the other in FIGS. 1 and 3) extending around the sides of the mounting bracket 18 and projecting toward the target element 12. The arms 34—34 are angled inwardly toward each other at their distal ends, on the opposite side of mounting bracket 18, to define a catch device 36—36 adapted to engage with a cooperating latching surface 38 of the target element 12.. The actuator bracket 32 (including arms 34—34 and catch device 36—36) moves relative to the mounting bracket 18 in response to movement of the plunger 26. In FIG. 1, the latching surface 38 comprises a grooved depression 40 and a projecting upper lip 42. The catch device 36 projects into the depression 40 and is engaged by the lip 42. Retaining spring 44 provides lateral force to keep the catch device 36 engaged with the latching surface 38 during controlled movement of the target element 12.

A biasing tension spring 46 is affixed to the bracket 18 and target 12 by respective notches 48,50. When the target 12 is in its lowered position (FIGS. 1 and 2), the spring 46 is relaxed. When the target 12 is in its upper position (FIGS. 3 and 4), the spring is extended and tensioned so as to bias the target 12 toward its lowered position. In the absence of any external force, therefore, the spring 46 maintains the target 12 in its lowered position. Movement of the target 12 from its lowered position to its raised position is achieved upon energization of the solenoid 22 and the engagement of the latching surface 38 of the target with the catch device 36 of the actuator bracket 32. Energization of the solenoid 22 causes the coil 24 to carry an electric current, which in turn generates a magnetic flux drawing the plunger 26 into the coil 24. Upward movement of the plunger 26 (for projecting the target into the playfield in the orientation shown in FIGS. 1–4), is achieved when the magnetic flux draws the plunger 26 upward with a force sufficient to overcome gravity and the bias of the spring 46.

An adjustable stop bracket 52 extends horizontally from a lower portion of the mounting bracket 18. When the drop target 10 is in its lowered position (FIG. 1), the stop bracket 52 thereby "stops" the drop target 10 at a height determined by the position of the stop bracket 52. The position of the stop bracket 52 is adjustable by means of an adjusting screw 56 to vary the relative height of the drop target 10 in its retracted position. Adjustment of the stop bracket 52 may be required, for example, to compensate for varying thicknesses of playfields and to ensure that the top surface of the drop target 10, when retracted, is below the top surface of the playfield.

Energization of the coil is achieved by applying an initial energizing pulse across the electrical contacts 28—28. In one embodiment, the initial energizing pulse is an ac voltage pulse having a magnitude of fifty volts and a duration of 32 milliseconds. It will be appreciated, however, that the initial pulse may comprise any electrical signal operable to produce a magnetic flux which draws the plunger 26 into the solenoid 22 with enough force to overcome gravity and the inertia of the spring 46. For example, the initial pulse may be other than an ac pulse, may have a magnitude greater than or less than fifty volts and/or may have a longer or shorter duration than 32 milliseconds. In response to the initial pulse, the plunger 26 moves upward into the coil to its uppermost position and the target 12 is moved into its raised position (FIG. 3). Thereafter, the plunger 26 and target 12 are maintained in their respective uppermost and raised positions by applying a successive pattern of energizing pulses across the electrical contacts 28—28 of the solenoid 22.

Figure 5:
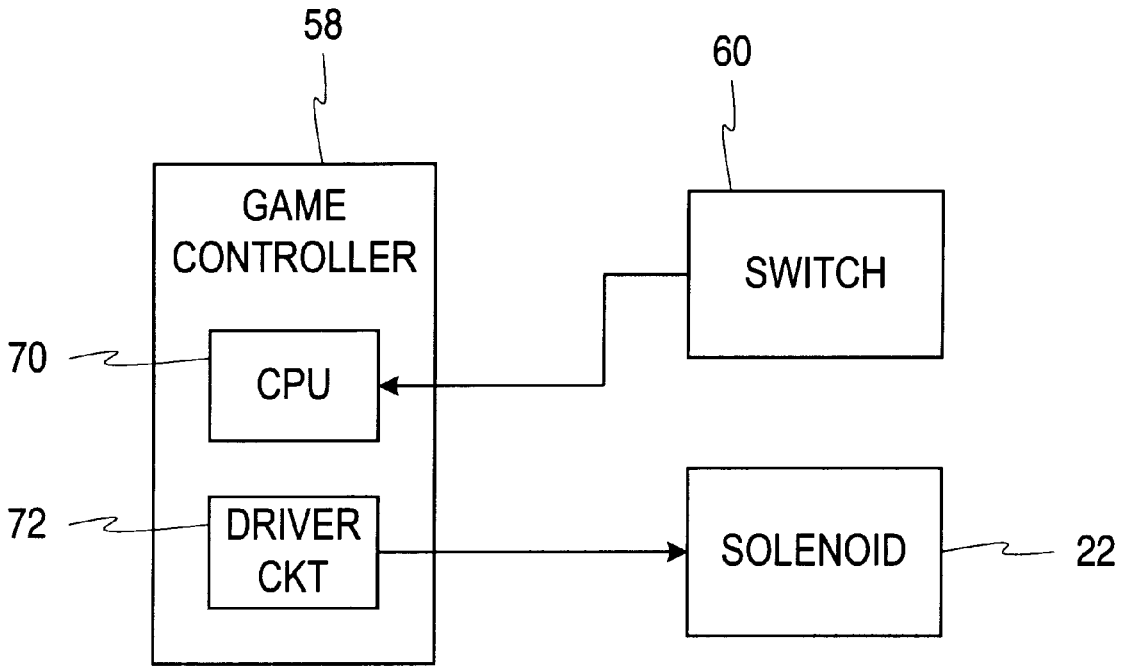
FIG. 5 is a block diagram illustrating operation of a game controller with the drop target of FIG. 1.

The successive pattern may comprise virtually any pattern of pulses which will produce a magnetic flux sufficient to hold the plunger 26 in its uppermost position. According to principles well known in the art, the energy required to hold the plunger 26 in its uppermost position is generally less than the energy required to move the plunger 26 to its uppermost position. It has been determined according to principles of the present invention that the required energy to hold the plunger 26 in its uppermost position may provided by a pattern of voltage pulses, applied after the initial pulse. The voltage pulses in the pattern may have generally the same magnitude as the initial voltage pulse but are applied intermittently and thereby require less energy than the initial pulse. The provision of such a pattern of pulses, at a relatively low energy level, causes the solenoid 22 to dissipate less heat and thereby prolongs the life of the solenoid 22. The pattern of pulses applied after the initial pulse may be fixed or, in one embodiment, may be variable during play of the pinball game according to instructions from a game controller 58 (FIG. 5).

In one embodiment, the pattern of pulses applied after the initial pulse is characterized by a repetitive frame of from one to n pulses, each pulse having a magnitude of 50 volts (same as the initial pulse) and a position within the frame corresponding to one of n available time windows. The characteristics of the frame, including the duration of the frame and the number of available time windows in the frame (which in combination define the duration of the time windows) is generally fixed by a game program and unalterable during play, but may be varied through appropriate revisions to the game program. In one embodiment, for example, the frame is programmed to be sixteen milliseconds in duration, with sixteen available time windows each having a duration of one millisecond.

The number of pulse(s) within the frame may be fixed or varied during play of the pinball game according to instructions from the game controller. In an embodiment having sixteen available time windows, for example, the game controller may designate a selected number of one to sixteen pulses to be applied during each frame. The relative "placement" of the pulse(s) in the frame (e.g., the particular time window(s) to which the pulse(s) will coincide) is generally predetermined by the game program. For example, in an embodiment where a single pulse is to be applied in a repetitive frame having sixteen one-millisecond time windows, the game program may cause the pulse to coincide with the first window of each frame. In like manner, in an embodiment where three pulses are to be applied in a repetitive frame having sixteen one-millisecond time windows, the game program may cause the pulses to coincide with the first, sixth and twelfth windows of the frame.

The repetitive pattern of pulses, as defined by the frame length, pulse length, and number of pulses in the frame determines the amount of energy that will be delivered to the solenoid 22 and the strength of "hold" of the plunger 26. For any pre-determined frame length and pulse length (generally defined by the game program), the energy delivered to the solenoid 22 is largely a function of the duty cycle of the pattern (defined by the number of pulses in the frame divided by the number of available time windows in the frame). The relative position of the pulses in the frame is largely irrelevant inasmuch as it does not affect the duty cycle of the pattern.

In a frame having sixteen one-millisecond time windows, for example, a pattern having only one pulse per frame (representing a 6.25% duty cycle) will provide a relatively weak hold but may nevertheless be sufficient to maintain the plunger 26 in its uppermost position. At the upper extreme, a pattern having sixteen pulses per frame (or 100% duty cycle) will provide a very strong hold but is generally inefficient because it requires the same amount of energy as a continuous "initial" pulse and would cause the solenoid 22 to dissipate a tremendous amount of heat. It has been determined that a relatively strong hold may be achieved at an efficient energy level with a pattern of two to four one-millisecond pulses substantially equally spaced in a sixteen-millisecond frame. In one embodiment, for example, the game controller applies a repetitive pattern of three one-millisecond voltage pulses in a sixteen-millisecond frame, defining an 18.75% duty cycle.

Independent of the strength of "hold," the target 12 can be dropped in the usual manner when a player strikes the target with a pinball 16, provided the pinball 16 has sufficient speed and momentum to cause the latching surface 42 to become disengaged from the catch device 36. When so disengaged, the target 12 is pulled to its lowered position by the spring 46. Additionally, a controlled drop may be executed without disengaging the latching surface 42 from the catch device 36, by the game controller 58 terminating the successive pulses or otherwise by providing pulses at an energy level insufficient to hold the plunger 26 in its uppermost position. Upon execution of the controlled drop, the plunger 26 and target 12 are moved to their lowermost positions, whereupon they may be raised again upon energization of the solenoid 22 in the manner heretofore described.

A switch 60, consisting of a body 61 and projecting actuator button 62, is provided for indicating the position of the target 12 to the game controller 58. An elongated rocker arm 64 is pivotally connected at one end to the switch body 61. The other end of the rocker arm 64 forms a triangular projection 66. When the drop target 10 is in its lower position (FIG. 1), the triangular projection 66 is engaged by a projecting indexing tab 68 of the drop target 10, causing the rocker arm 64 to depress the actuator button 62 and signal the game controller 58 that the target 12 is in the lower position. When the target 12 is in its upper position (FIG. 3), the tab 68 is moved away from engagement with the rocker arm projection 66, releasing the pressure on the actuator button 62 (thereby allowing the actuator button 62 to return to its undepressed state) and causing the rocker arm projection 66 to move back into the path of the indexing tab 68. The corresponding signals from the switch 60 indicates to the game controller 58 whether the target 12 is in the raised or lowered position. The switch may be normally open or normally closed and wired for positive or negative logic in their regard, to cooperate with the logic scheme of the controller.

FIG. 5 is a block diagram illustrating the functional relationship between the game controller 58, switch 60 and solenoid 22. The game controller 58 includes generally a CPU 70 and a driver circuit 72. The CPU 70 includes a memory (not shown) for storing control software, operational instructions and data associated with the pinball game. The CPU 70 controls play of the pinball game according to the control software and responsive to the presence or absence of signals from the switch 60. At appropriate times, the CPU 70 activates the driver circuit 72 to produce, respectively, either the initial energizing pulse, successive pattern of energizing pulses or termination of energizing pulses as heretofore described. The game controller 58 may be programmed via control software to vary the characteristics (e.g., magnitude, duration, or pattern) of the initial energizing pulse or successive pattern of energizing pulses. Alternatively, a device other than a solenoid may be provided to drive the target between its upper and lower positions in response to signals from the game controller 58.

The game controller 58 monitors both the position of the target 12 and the status of the solenoid to determine whether the target was knocked down by a skilled shot or by a controlled drop. In the former case, the game controller will typically activate electrical switching to advance the player's score. The game controller 58 may also verify successful execution of a controlled drop or rise of the target 12. More particularly, the game controller 58 will determine that either of the following four conditions exist:

1) The solenoid is energized and the target is up;

2) The solenoid is energized and the target is down;

3) The solenoid is de-energized and the target is up; or

4) The solenoid is de-energized and the target is down.

If condition (1) occurs, the game controller 58 verifies that a successful rise or resetting of the target 12 has occurred. If condition (2) occurs during play of the game, the game controller 58 determines that the target 12 has been dropped by a skilled shot, registers a score on the pinball machine as appropriate, and de-energizes the solenoid to re-engage the target latching surface 38 with the catch 36 of the actuator bracket 32. Condition (2) may also occur in a test mode in which, for example, a technician may evaluate operation of the device in response to different levels and/or patterns of engergizing pulses. In the test mode, occurrence of condition (2) may indicate to the technician that the solenoid 22 has been energized with insufficient power to overcome the bias of the spring 46, or perhaps that some malfunction exists (such as a broken switch 60, loose connection, etc.) that would cause power otherwise sufficient to overcome the bias of the spring 46 not to be delivered to the solenoid 22. Thereafter, the technician may adjust the pattern and/or level of energizing pulses, repair or replace electrical components as appropriate. Condition (3) generally will not occur under normal circumstances and its occurrence would thereby indicate to the game controller 58 or technician that some other malfunction exists. For example, the occurrence of condition (3) may indicate that the target 12 is actually down but, due perhaps to failure of the switch 60 or failure of the rocker arm 64 to properly depress the actuator button 62, the target 12 is erroneously indicated to be up. Finally, if condition (4) occurs, the game controller 58 verifies that a successful controlled drop of the target 12 has occurred.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A drop target for a pinball game comprising:

a target element movable between a raised and lowered position;

a target driver movable between a first and second position; and a latching mechanism for linking the target driver to the target element, the latching mechanism being engagable with said target element for causing movement of said target element to one of said raised and lowered positions in response to movement of said target driver from said first position to said second position, and for causing movement of said target element to the other of said raised and lowered positions in response to movement of said target driver from said second position to said first position.

2. The drop target of claim 1 wherein the latching mechanism comprises an actuator bracket and catch element, the actuator bracket being fixedly connected to the target driver, the catch element being defined on an extension of the actuator bracket and adapted for engagement and disengagement with a latching surface of said target element, the actuator bracket and catch element moving in cooperation with the target driver for causing movement of said target element between said raised and lowered positions when said catch element is engaged with the latching surface of said target element.

3. The drop target of claim 1 wherein the target driver comprises a solenoid including a coil and a plunger concentric with the coil, the coil being energizable to create a magnetic field about the plunger and de-energizable to extinguish the magnetic field about the plunger, the plunger moving in response to the creation of said magnetic field to one of said first and second positions, the plunger moving in response to the extinguishing of said magnetic field to the other of said first and second positions.

4. The drop target of claim 3 wherein the first and second positions of said plunger define extended and retracted positions, the drop target including means biasing the plunger toward one of the extended and retracted positions, the plunger moving in response to the creation of said magnetic field to the other of the extended and retracted positions.

5. A drop target for a pinball game comprising:

a target element movable between a raised and lowered position;

a target driver movable between first and second positions; and a latching mechanism for linking the target driver to the target element, the latching mechanism being engagable with said target element for causing movement of said target element from said lowered position to said raised position in response to movement of said target driver from said first position to said second position, and for causing movement of said target element from said raised position to said lowered position in response to movement of said target driver from said second position to said first position.

6. The drop target of claim 5 wherein the target driver comprises a single solenoid including a coil and a plunger concentric with the coil, the coil being energizable to create a magnetic field about the plunger and de-energizable to extinguish the magnetic field about the plunger, the plunger moving in response to the creation of said magnetic field from a lower vertical position defining the first position of said target driver to an upper vertical position defining the second position of said target driver, the plunger moving in response to the extinguishing of said magnetic field from said upper vertical position to said lower vertical position.

7. A drop target for a pinball game comprising:

a target element having a latching surface;

a movable latching mechanism engagable with the latching surface; and means for moving the latching mechanism between first and second positions, the target element moving in cooperation with the latching mechanism when said latching mechanism is engaged with the latching surface, the target element being moved to a lowered target position by said latching mechanism when the latching mechanism is moved to one of said first and second positions and when said latching mechanism is engaged with the latching surface, the target element being moved to a raised target position by said latching mechanism when the latching mechanism is moved to the other of said first and second positions and when said latching mechanism is engaged with the latching surface.

8. The drop target of claim 7 wherein the means for moving the latching mechanism comprises a target driver operably connected to the latching mechanism, the target driver being movable between a first target driver position and a second target driver position in response to control signals from a game controller, the latching mechanism moving in cooperation with the target driver, the latching mechanism being in said first position when the target driver is in said first target driver position, the latching mechanism being in said second position when the target driver is in said second target driver position.

9. The drop target of claim 8 wherein the target driver comprises a single solenoid including a coil and a plunger concentric with the coil, the coil being energizable in response to said control signals to create a magnetic field about the plunger, the plunger being biased in an absence of said magnetic field in one of said first and second target driver positions, the plunger moving in response to the creation of said magnetic field to the other of said first and second target driver positions.

10. The drop target of claim 9 wherein the plunger, the target driver, the latching mechanism and the target element are operatively associated so that the target element moves from said lowered target position to said raised target position in response to creation of said magnetic field.

11. The drop target of claim 10 wherein the control signals include a pattern of energizing pulses of electric current, the plunger being maintained in said second target driver position, the latching mechanism being maintained in said second vertical position and the target element being maintained in said raised target position in response to said pattern of energizing pulses.

12. The drop target of claim 11 wherein the pattern of energizing pulses is characterized by a selected number of pulses applied in a repetitive frame.

13. The drop target of claim 12 wherein the selected number of pulses is variable during play of the pinball game.

14. The drop target of claim 12 wherein the repetitive frame defines a fixed number of available time windows, each of the selected number of pulses being applied coincident to one of the available time windows.

15. The drop target of claim 14 wherein the repetitive frame defines sixteen available time windows.

16. The drop target of claim 15 wherein each of the time windows has a duration of about one millisecond.

17. The drop target of claim 15 wherein the selected number of pulses comprises between two and four pulses per frame.

18. The drop target of claim 15 wherein the selected number of pulses comprises three pulses per frame.

19. The drop target of claim 11 including means for terminating said pattern of energizing pulses, the plunger moving from said second target driver position to said first target driver position, the latching mechanism moving from said second vertical position to said first vertical position and the target element moving from said raised target position to said lowered target position in response to termination of said pattern of energizing pulses.

20. A pinball game comprising:

a playfield;

a target element movable between a raised and lowered position relative to said playfield;

a target driver movable between first and second positions;

a latching mechanism for linking the target driver to the target element, the latching mechanism being engagable with said target element for causing movement of said target element from said lowered position to said raised position in response to movement of said target driver from said first position to said second position, and for causing movement of said target element from said raised position to said lowered position in response to movement of said target driver from said second position to said first position;

wherein said target driver is responsive to control signals for moving between said first and second positions; and a game controller for providing said control signals.

21. A pinball game comprising:

a playfield;

a target element movable between a raised and lowered position relative to said playfield;

a target driver movable between first and second positions; and a latching mechanism for linking the target driver to the target element, the latching mechanism being engagable with said target element for causing movement of said target element from said lowered position to said raised position in response to movement of said target driver from said first position to said second position, and for causing movement of said target element from said raised position to said lowered position in response to movement of said target driver from said second position to said first position;

wherein the target driver comprises a single solenoid including a coil and a plunger concentric with the coil, the coil being energizable to create a magnetic field about the plunger and de-energizable to extinguish the magnetic field about the plunger, the plunger moving in response to the creation of said magnetic field from a lower vertical position defining the first position of said target driver to an upper vertical position defining the second position of said target driver, the plunger moving in response to the extinguishing of said magnetic field from said upper vertical position to said lower vertical position; and a game controller for engaging and de-energizing the coil.

22. A method of moving a target element for a pinball game from a lowered position to a raised position and from the raised position to the lowered position, the method comprising the steps of:

linking the target element to a movable latching device;

moving the latching device from a first to a second position, the target element moving in cooperation with the latching device, the target element being in said lowered position when the latching device is in said first position, the target element being moved to said raised position when the latching device is moved to said second position; and moving the latching device from the second position to the first position, the target element moving in cooperation with the latching device, the target element being in said raised position when the latching device is in said second position, the target element being moved to said lowered position when the latching device is moved to said first position.

23. The method of claim 22 wherein the movable latching device includes a solenoid having a coil and a movable plunger concentric with the coil, the step of moving the latching device from the first position to the second position comprising energizing the solenoid to create a magnetic field about the plunger, the plunger moving in response to the creation of said magnetic field from said first position to said second position; and the step of moving the latching device from the second position to the first position comprising de-energizing the solenoid to extinguish the magnetic field about the plunger, the plunger moving in response to the extinguishing of said magnetic field from said second position to said first position.

24. A method of moving a target element for a pinball game between a raised and lowered position, the method comprising the steps of:

linking the target element to a movable latching device including a solenoid having a coil and a movable plunger concentric with the coil; and moving the latching device between a first and second position, the target element moving in cooperation with the latching device, the target element being in said lowered position when the latching device is in said first position, the target element being moved to said raised position when the latching device is moved to said second position, the step of moving the latching device between the first and second positions comprising:

(a) energizing the solenoid to create a magnetic field about the plunger, the plunger moving in response to the creation of said magnetic field from said first position to said second position; and (b) de-energizing the solenoid to extinguish the magnetic field about the plunger, the plunger moving in response to the extinguishing of said magnetic field from said second position to said first position, wherein the step of energizing the solenoid comprises the steps of:

applying an initial energizing pulse to the coil, the plunger moving from said first position to said second position in response to the initial energizing pulse; and applying a pattern of succeeding energizing pulses to the coil, the plunger being maintained in said second position in response to said pattern of succeeding energizing pulses.

25. The method of claim 24 wherein the step of applying a pattern of succeeding energizing pulses to the coil comprises applying a selected number of pulses in a repetitive frame.

26. The method of claim 25 wherein the repetitive frame defines sixteen available time windows, each of the time windows having a duration of about one millisecond, each of the selected number of pulses being applied coincident to one of the time windows.

27. The method of claim 24 wherein the step of de-energizing the solenoid comprises the step of terminating the pattern of succeeding energizing pulses, the plunger moving from said second position to said first position in response to termination of said pattern of succeeding energizing pulses.

* * * * *